US005624090A

United States Patent [19]

Gammelgaard

[11] Patent Number: 5,624,090

[45] Date of Patent: Apr. 29, 1997

[54] INFANT FEEDING SYSTEM

[76] Inventor: Rebecca Gammelgaard, 466 Oak Hill Rd., Chaska, Minn. 55318

[21] Appl. No.: 410,843

[22] Filed: Mar. 27, 1995

[51] Int. Cl.[6] ..... F10M 11/00

[52] U.S. Cl. ..... 248/102; 248/200

[58] Field of Search ..... 248/102, 103, 248/104, 105, 106; 446/227, 369, 24

[56] References Cited

U.S. PATENT DOCUMENTS

| | | | |
|---|---|---|---|
| D. 141,700 | 6/1945 | Raport . | |
| D. 153,937 | 5/1949 | Graboi . | |
| D. 160,192 | 9/1950 | Miller . | |
| D. 305,346 | 1/1990 | Roberts | D21/162 |
| D. 310,418 | 9/1990 | Tribolet | D24/48 |
| D. 314,432 | 2/1991 | Shaw | D24/48 |
| D. 322,128 | 12/1991 | Martinez, Jr. | D24/199 |
| D. 334,983 | 4/1993 | Nicholls | D24/198 |
| 2,354,568 | 7/1944 | Allen . | |
| 2,450,927 | 10/1948 | Allen | 248/104 |
| 2,451,718 | 10/1948 | Corrao | 248/105 |
| 2,485,461 | 10/1949 | Siegel | 248/102 |
| 2,631,288 | 3/1953 | Daust | 2/49 |
| 2,711,052 | 6/1955 | Brayford | 46/116 |
| 4,064,576 | 12/1977 | Threatt | 5/334 |
| 4,564,957 | 1/1986 | Scharf | 2/73 |
| 4,726,551 | 2/1988 | Randall et al. | 248/102 |
| 4,809,938 | 3/1989 | Skinner et al. | 248/102 |
| 4,895,327 | 1/1990 | Malone et al. | 248/102 |
| 4,902,261 | 2/1990 | Pratt et al. | 248/102 X |
| 4,951,997 | 8/1990 | Kenney | 248/103 X |
| 5,183,229 | 2/1993 | Duggan | 248/102 |
| 5,184,796 | 2/1993 | Maher | 248/102 |
| 5,217,192 | 6/1993 | Oktayuren | 248/102 |

*Primary Examiner*—Creighton Smith
*Attorney, Agent, or Firm*—Kinney & Lange P.A.

[57] ABSTRACT

An infant feeding system including a baby bottle, a support member for providing a stable resting place for the baby bottle when positioned thereon, a grasping mechanism adapted to receive and hold the baby bottle therein, and a mounting mechanism for engaging the grasping mechanism to a point on the support member. The grasping mechanism and baby bottle are rotationally adjustable and/or removable with respect to the support member to accommodate a variety of feeding positions.

14 Claims, 3 Drawing Sheets

INFANT FEEDING SYSTEM

BACKGROUND OF THE INVENTION

The present invention relates generally to infant feeding systems, and more particularly, to an infant feeding system which includes a baby bottle for feeding the infant and a support member upon which the baby bottle is positioned so that a caregiver is not required to continuously hold and support the baby bottle for the infant.

Feeding systems which allow an infant to receive liquid nourishment unassisted by a caregiver are known in the art. These devices generally include a baby bottle and a support member usually in the form of a stuffed animal or other friendly looking creature. Many of these systems also provide a mechanism attached to the support member for grasping the baby bottle and maintaining the baby bottle in a fixed relationship with respect to the support member for feeding purposes.

One of the problems associated with the prior art designs is that the lateral orientation of the baby bottle is fixed with respect to the support member so as to provide only one feeding position. Another problem with the prior art devices is that the grasping mechanism which engages the baby bottle to the support member does not provide a constant tension around the bottle to prevent undesired movement of the baby bottle within the grasping mechanism during feeding. Even more, these grasping mechanism are not removable from the support structure thereby leading to more difficult operation and mounting of the baby bottle.

SUMMARY OF THE INVENTION

The present invention provides an infant feeding system including a baby bottle, a support member for providing a stable resting place for the baby bottle when positioned thereon, a grasping mechanism adapted to receive and hold the baby bottle therein, and a mounting mechanism for engaging the grasping mechanism to a point on the support member. Preferably, the grasping mechanism and baby bottle are rotationally adjustable with respect to the support member to accommodate a variety of feeding positions.

In one arrangement, the grasping member is in the form of an elastic loop section which frictionally fits around the center section of the baby bottle. In this arrangement the mounting mechanism is a rotational snap or other similar structure permitting a full 360° rotation of the baby bottle with respect to the support member. The snap structure may also provide removable attachment of the loop structure and baby bottle to the support structure for added versatility.

In another arrangement, the grasping member is in the form of a bottle warmer which fits around the entire baby bottle with the exception of the nipple end for keeping formula in the baby bottle at a desired temperature. In this arrangement the mounting mechanism is a hook and loop fastener or other similar structure which provides removable attachment of the bottle warmer to the support member. The hook and loop fastener may also provide removable attachment of the elastic loop section and baby bottle to the support structure.

Figure 6A:
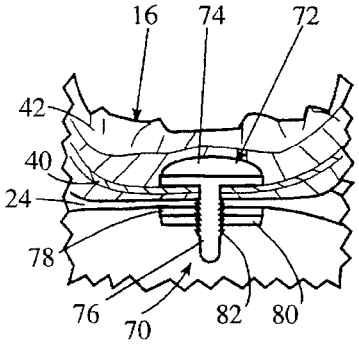
FIG. 6 is a perspective view with portions illustrated in sectional view of the infant feeding system of FIGS. 4 and 5 illustrating one embodiment of the mounting mechanism for rotationally mounting the loop member to the support member.
Figure 6:
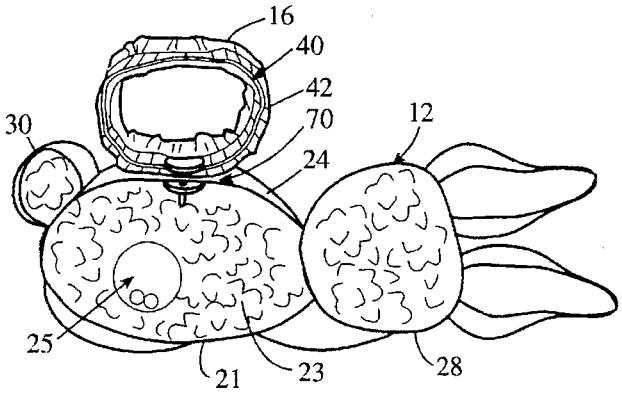

FIG. **6*a* is an enlarged fragmentary sectional view of the mounting mechanism of FIG. 6**.

Figure 4:
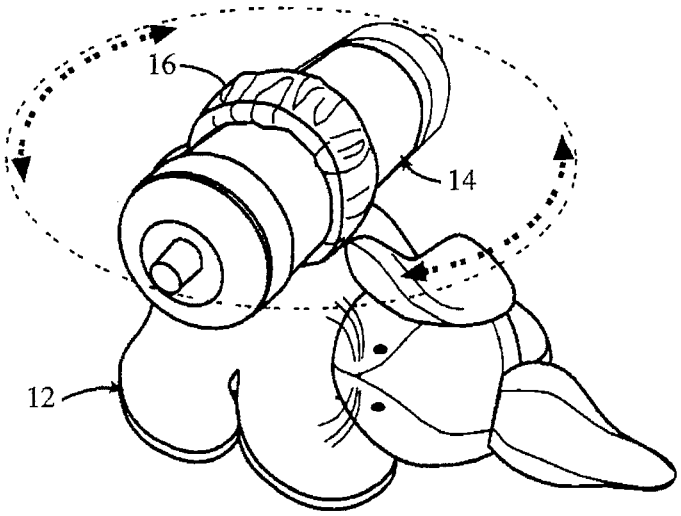
FIG. 4 is a perspective view of the infant feeding system showing the rotational range of motion of the baby bottle with respect to the support member.
Figure 5:
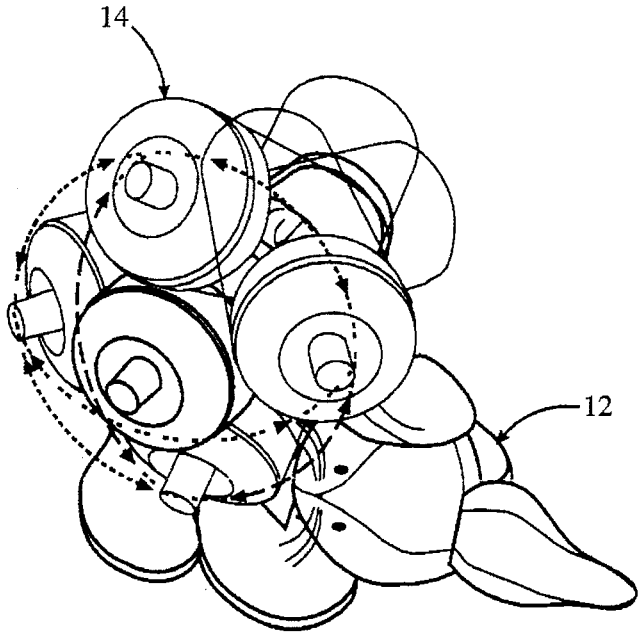
FIG. 5 is a perspective view of the infant feeding system showing the rotational and vertical range motion of the baby bottle with respect to the support member.
Figure 7:
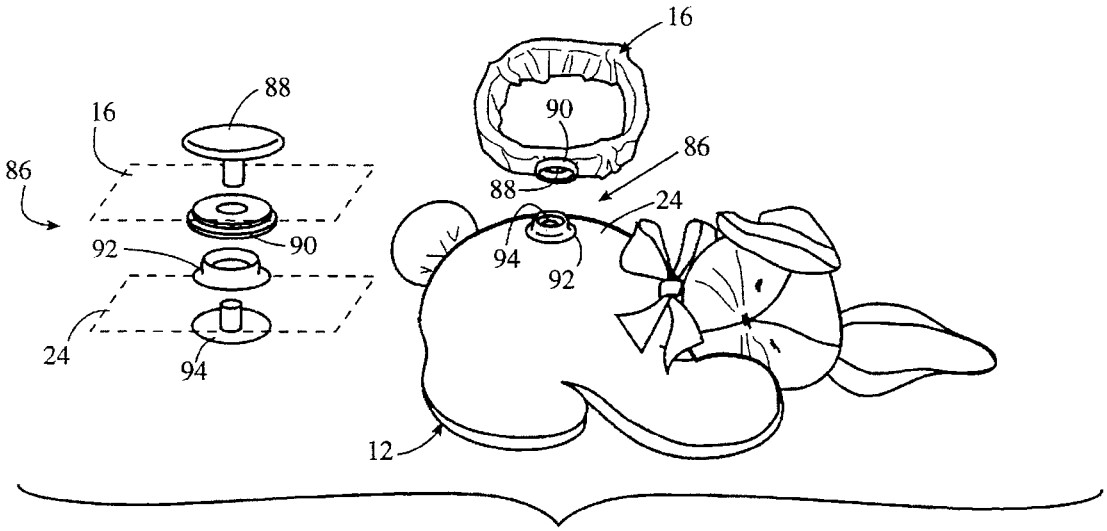

FIG. 7 is a perspective view of the infant feeding system of FIGS. 4 and 5 showing another embodiment of the mounting mechanism.

Figure 8:
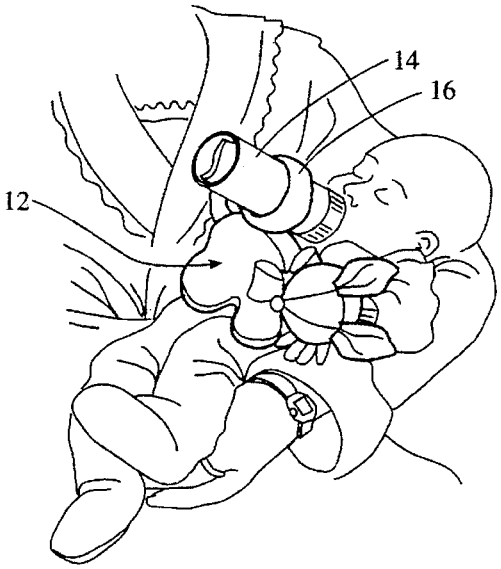

FIG. 8 is a perspective view of the infant feeding system shown in use with a caregiver.

DETAILED DESCRIPTION OF THE PREFERRED EMBODIMENTS

Figure 1:
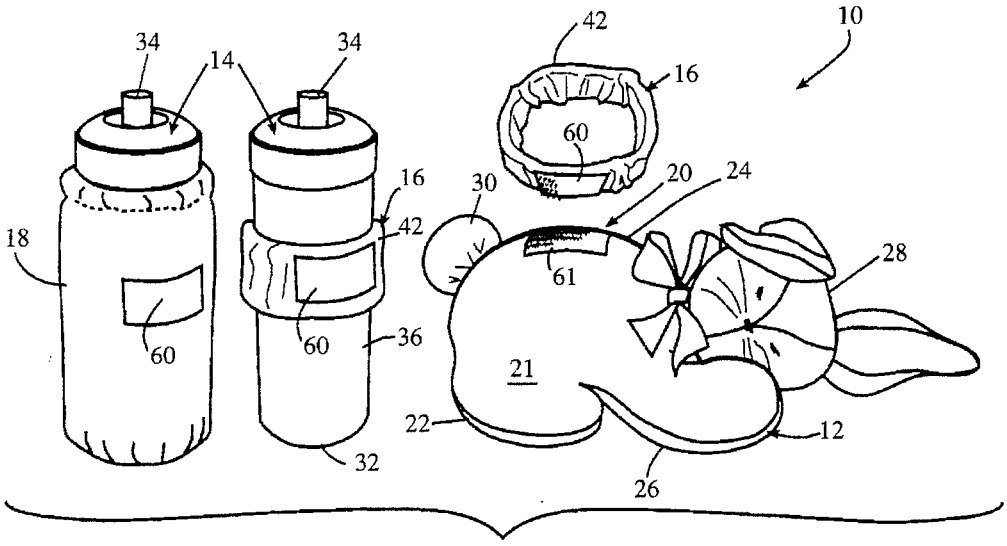
FIG. 1 is a perspective view of an infant feeding system according to the present invention.
Figure 2A:
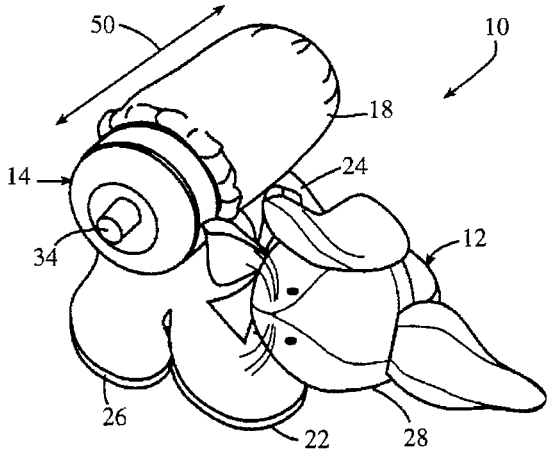
FIGS. 2A and 2B are perspective views of the infant feeding system of FIG. 1, wherein the baby bottle is now shown attached to the support member.
Figure 2B:
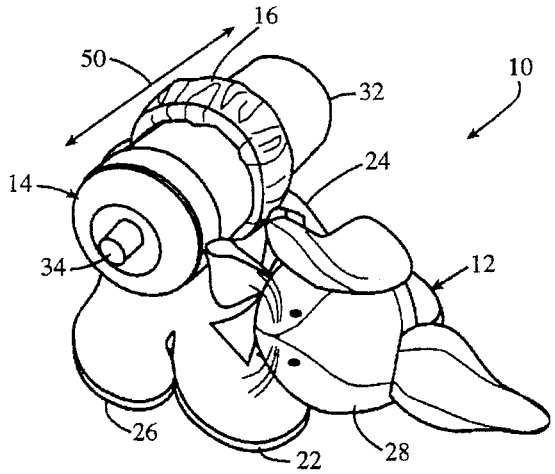
Figure 3:
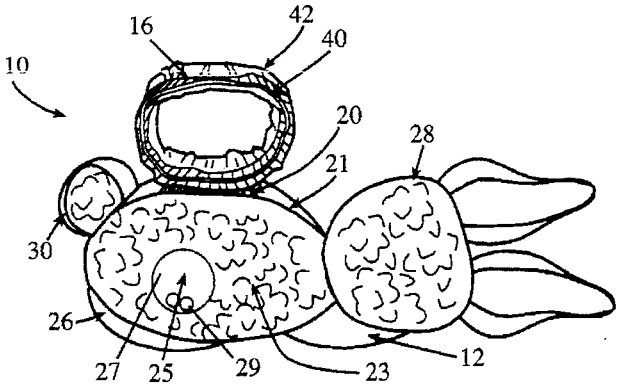
FIG. 3 is a sectional view of the infant feeding system of FIG. 2B.

The arrangement shown in FIGS. 1–3 illustrates an infant feeding system 10 including a support member 12, a pair of baby bottles (each denoted with reference numeral 14), a grasping member in the form of a loop section 16, a grasping member in the form of a bottle warmer 18, and a mounting mechanism 20. The baby bottle 14 is frictionally fit within either the loop section 16 or the bottle warmer 18 and then attached to the support member 12 using the mounting mechanism 20. The removable grasping member makes possible the attachment of either the bottle warmer 18 or the loop section 16 depending on the needs of the caregiver.

As shown in FIG. 1, the support member 12 includes a base surface 22, a top surface 24, a plurality of legs 26, a head 28, and a tail 30. The base surface 22 is broader than the top surface 24 to provide stability for the support member 12 and to ensure that the baby bottle 14, when positioned thereon, tilts downward toward the infant's mouth. The legs 26 and head 28 also provide stability, while the tail is primarily for decorative purposes to complete the design of a stuffed animal. Referring to FIG. 3, the support member 12 is made of a soft fabric which acts as an outer shell 21 and is stuffed with a fiber filler 23. The light weight of the fiber filler 23 does not harm the infant and allows the support structure 12 to remain attached to the baby bottle 14 and grasping member when the baby bottle 14 is stood upright on a table (not shown) if not in use. Throughout the drawings, the support member 12 is shown in the form of a barn yard animal such as a rabbit. Of course, it is to be understood that the form of the support member 12 may be of any animal, infant friendly creature, fanciful creature or geometric shape.

A conventional rattle device 25 is positioned within the fiber filler 23 of the support member 12. The rattle device 25 includes a hollow member 27, and a plurality of small beads 29 movable within the hollow member 27. When the small beads 29 contact each other and the wall of the hollow member 27 a rattle sound is created. Devices other than a rattle that emit a pleasing sound can be positioned within the fiber fill, such as a musical sound emitting device.

The baby bottle 14 includes a bottom end 32, a nipple end 34, and side walls 36. The construction of the baby bottle 14 is well known in the art and its use is well known for feeding infants.

As shown particularly in FIG. 1 and FIG. 2A, the bottle warmer 18 is removably attachable to the support member 12. The bottle warmer 18 is made of an insulative outer wrap encircling the entire bottom end 32 and side walls 34 of the baby bottle 14 to the keep the liquid formula therein at a constant temperature for extended periods of time, and a inner elastic member (not shown, but similar to the elastic material 40 shown in FIG. 3 and described below) to hold the baby bottle in a desired position with respect to the support member 12 when positioned thereon. Alternatively, the warmer may cover only the side walls 36 and leave a portion or the entire bottom of the bottle exposed. By positioning the bottle warmer 18 on the top side 24 of the support member 12 and by making the top side 24 of the support member 12 narrower than the base 22 of the support member, the nipple end 34 of the bottle 14 tilts downward toward the infants mouth (as shown in FIG. 8). The insulative outer wrap of the warmer 18 may contain microwavable and freezer gel packs (not shown) that are removable from the warmer 18 and that can be placed in a freezer or microwave. The baby bottle 14 is slidably movable within the bottle warmer 18 along the direction of arrow 50 so that the baby bottle 14 is positionable at the proper distance from the infant's mouth to accommodate a variety of feeding positions.

As shown particularly in FIGS. 1, 2B, and 3 the loop section 16 also functions to hold the baby bottle 14 in position with respect to the support member 12 when positioned thereon. The loop section 16 is also removably attachable to the support member 12 in the same manner as the bottle warmer 18. The loop section 16 includes a continuous loop or band of elastic material 40 (see FIG. 3) enclosed inside a fabric casing 42. The diameter of the elastic material 40 is slightly less than the diameter of the baby bottle 14 so as to provide enough pressure (friction) to hold the baby bottle is a desired position. The elastic material 40 also conforms to fit a variety of different sized baby bottles due to its stretchable nature. The baby bottle 14 is also slidably movable within the loop section 16 along the direction of arrow 50 so that the baby bottle 14 is positionable at the proper distance to the infants mouth to accommodate a variety of feeding positions.

A variety of mounting mechanisms 20 for attaching the grasping member to the support member 12 may be used. FIG. 1 illustrates a hook and loop tape 60, 61 where one section 60 is permanently fixed to the grasping member and the other section 61 is permanently fixed to the top surface 24 of the support member 12. The hook and loop tape 60, 61 allows the loop section 16 or bottle warmer 18, and consequently the baby bottle 14, to be removably attached to the support member 12. This method of attachment is easy to use and allows the baby bottle 14 to be attached and detached quickly for purposes such as refrigeration. In addition, the hook or loop section 61 on the support member 12 is larger than the hook or loop section 60 on the grasping member to permit the grasping member to be placed in a variety of positions on the support member to further aid in providing a variety of infant feeding positions.

FIG. 4 illustrates a desired range of motion for the baby bottle 14 with respect to the support member 12. More particularly, it is desirable that the baby bottle 14 be laterally rotatable a full 360° to provide a variety of feeding positions. FIG. 5 illustrates a further desired range of motion wherein the baby bottle 14 is, in addition to being laterally rotatable over the full 360° range, vertically pivotal with respect to the support member 12. In other words, regardless of the orientation of the support member 12 with respect to the infant, the present invention provides that the baby bottle 14 may be adjusted vertically, and laterally over the full 360° range to properly orient the nipple end 34 of the baby bottle with the infant's mouth.

Accordingly, it is preferred that the mounting mechanism 20 be in the form of a rotational joint. While FIGS. 6 and 7 illustrate two different types of such rotational joints, it is to be understood that other such rotational joints maybe used without departing from the spirit and scope of the invention. More particularly, FIG. 6 illustrates a fixed pin and washer assembly 70. The pin and washer assembly 70 includes a pin 72 (having a pin head 74 and a pin shaft 76), a first washer 78, and a second washer 80. The pin shaft 74 is threaded through the grasping member (which is loop section 16 in FIG. 6) and into the top surface 24 of the support body 12. The first and second washers 78 and 80 are positioned on the bottom side of the top surface 24 and engage the pin shaft 76. The pin shaft 76 includes teeth 82 angled to fixedly engage the first and second washers 78 and 80. By positioning the first and second washers 78 and 80 adjacent one another the loop section 16 is free to rotate with respect to the support member 12.

FIG. 7 shows an arrangement of the mounting mechanism 20 wherein the grasping member is removably attachable to the support member. More particularly, the mounting mechanism 20 includes a rotational snap 86 having a top snap base 88, a top snap section 90, a bottom snap base 92, and a bottom snap section 94. The top snap base 88 is positioned within the grasping member so that the elastic material 40 and fabric casing 42 of the loop section 16 are fixed between the top snap base 88 and the top snap section 90. The top snap base 88 and the top snap section 90 frictionally fit together so as to form a top snap. Similarly, the bottom snap base 92 is positioned within the interior of the support member 12 so that the top surface 24 of the support member 12 is fixed between the bottom snap base 92 and the bottom snap section 94. The bottom snap base 92 and the bottom snap section 94 are frictionally fit together so as to form a bottom snap. The top snap and the bottom snap are removably engageable with each other allowing the loop section 16 or bottle warmer 18 to be removed from and attached to the support member 12 depending on the needs or desires of the caregiver. The top snap and bottom snap are also fully rotational with respect to each other so that the grasping member is free to rotate a full 360° with respect to the support member 12.

FIG. 8 shows the infant feeding system 10 in use. The infant is shown in the arms of the caregiver and the support member 12 is positioned on the infant so that the baby bottle 14 is positioned in the infant's mouth. The mounting mechanism 20 permits the lateral rotation and vertical pivoting of the baby bottle to provide a variety of feeding positions so that regardless of the orientation of the infant's mouth with respect to the support member 12, the baby bottle 14 is positionable for feeding. For example, if the infant is lying on its stomach or side in a crib or reclining in a stroller, the support member 12 and baby bottle 14 are adjustable with respect to each other to permit feeding.

Although the present invention has been described with reference to preferred embodiments, workers skilled in the art will recognize that changes may be made in form and detail without departing from the spirit and scope of the invention.

What is claimed is:

1. An infant feeding system comprising:

a baby bottle having a nipple end, a bottom end, and side walls connecting the nipple end to the bottom end;

a support member providing a stable resting support for the baby bottle when positioned thereon;

a grasping member sized to receive and hold the baby bottle therein; and a mount that grasps the grasping member at a point on the support member so that the grasping member and baby bottle are rotationally adjustable with respect to the support member to accommodate a variety of feeding positions.

2. The infant feeding system of claim 1, wherein the grasping member is an elastic loop section, and wherein the support member is in the form of an stuffed animal.

3. The infant feeding system of claim 1, further comprising a sound emitting device positioned within the stuffed animal.

4. The infant feeding system of claim 2, wherein the stuffed animal has a top surface and a base, wherein the base is wider than the top surface, and wherein the grasping member is rotationally mounted on the top surface.

5. The infant feeding system of claim 1, wherein the grasping member includes an elastic band loop surrounded by a fabric casing wherein a diameter of the elastic band loop is slightly smaller than a diameter of the baby bottle.

6. The infant feeding system of claim 1, wherein the mount permits the baby bottle to laterally rotate 360° with respect to the support member.

7. The infant feeding system of claim 6, wherein the mount permits removable attachment of the grasping member to the support member.

8. The infant feeding system of claim 7, wherein the mount includes a top snap, a bottom snap, the top and bottom snap being removably and rotationally engageable with each other.

9. The infant feeding system of claim 1, wherein the mount includes a lock washer and pin having teeth engageable with the lock washer.

10. The infant feeding system of claim 1, wherein the grasping member is a bottle warmer surrounding at least the side wall of the baby bottle so that the nipple end is exposed and so that formula in the baby bottle is kept warm.

11. An infant feeding system comprising:

a baby bottle having a nipple end, a bottom end, and side walls connecting the nipple end to the bottom end;

a support member supporting the baby bottle when positioned thereon;

wherein the support member is in the form of a stuffed animal, and wherein the infant feeding system further comprises a sound emitting device positioned within the stuffed animal:

a loop member sized to receive and hold the baby bottle therein; and a mount for removably attaching the loop member to the support member so that the loop member and baby bottle are removable together as a unit from the support member.

12. The infant feeding system of claim 11, wherein the loop member includes an elastic band loop surrounded by a fabric casing, wherein a diameter of the elastic band is slightly smaller than a diameter of the baby bottle.

13. The infant feeding system of claim 11, wherein the mount permits the baby bottle to laterally rotate 360° with respect to the support member.

14. The infant feeding system of claim 11, further comprising a bottle warmer encompassing the loop member, the bottle warmer surrounding the bottom end and side wall of the baby bottle so that the nipple end is exposed and so that formula in the baby bottle is kept warm.

* * * * *